United States Patent [19]

Murphy

[11] 4,121,710

[45] Oct. 24, 1978

[54] DISPLAY BIN

[76] Inventor: Thomas V. Murphy, P.O. Box 156, Oradell, N.J. 07649

[21] Appl. No.: 808,035

[22] Filed: Jun. 20, 1977

Related U.S. Application Data

[63] Continuation-in-part of Ser. No. 733,096, Oct. 18, 1976, abandoned.

[51] Int. Cl.[2] ..... B65D 3/14; B65D 3/04

[52] U.S. Cl. ..... 206/45.16; 206/45.31; 211/128; 211/151; 229/4.5; 229/5.5; 248/129

[58] Field of Search ..... 248/174, 129; 312/259, 312/260, 264, 265; 211/128, 133, 135, 151; 206/45, 44 R, 44 K, 45.11, 44.11, 45.31, 45.34, 45.16; 229/16 C, 21, 16 D, 5.5, 24, 4.5, 25

[56] References Cited

U.S. PATENT DOCUMENTS

| | | | |
|---|---|---|---|
| 1,113,350 | 10/1914 | Inman | 229/21 |
| 1,641,283 | 9/1927 | MacDougall | 206/45.16 |
| 1,680,539 | 8/1928 | Hadi | 206/45.16 |
| 1,804,539 | 5/1931 | Mineck | 206/45.16 |
| 1,991,746 | 2/1935 | Hiatt | 229/21 |
| 2,022,601 | 11/1935 | McDonald | 229/21 |
| 3,297,372 | 1/1967 | Brader | 248/129 |
| 3,313,333 | 4/1967 | Lordi | 150/0.5 |
| 3,451,610 | 6/1969 | Beichler et al. | 229/21 |
| 3,528,676 | 9/1970 | Marcandalli | 248/129 |
| 3,834,609 | 9/1974 | Congleton | 229/2.5 |

FOREIGN PATENT DOCUMENTS

| | | | |
|---|---|---|---|
| 1,055,558 | 2/1954 | France | 229/21 |

*Primary Examiner*—William Price
*Assistant Examiner*—Bruce H. Bernstein
*Attorney, Agent, or Firm*—Mandeville and Schweitzer

[57] ABSTRACT

The disclosure relates to a display bin for storing and displaying general items of merchandise for sale in retail stores, supermarkets and similar establishments. In general, the bin of the invention is assembled from flat, molded sheets. A rectangular, flexible wall sheet is provided with a plurality of fastening means spaced across at least the end edge portions thereof and a plurality of vertical ribs spaced in parallel relation across the bottom edge thereof. The wall sheet is bent into a three-dimensional wall body of closed configuration whereby the end edge portions overlap and the fastening means of the overlapping portions hold the bent sheet in the desired configuration. The wall body is arranged such that the vertical ribs project internally of the body. A bottom plate is inserted into the open top end of the body and lowered until it is supported by the vertical ribs, to complete the display bin.

12 Claims, 15 Drawing Figures

DISPLAY BIN

RELATED APPLICATION

This application is a continuation-in-part of my copending application Ser. No. 733,096, filed Oct. 18, 1976, now abandoned.

BACKGROUND AND SUMMARY OF THE INVENTION

Retail stores and supermarkets sell a great variety of small items such as novelty items, toys, household products, etc. It is often desirous to have a point of purchase display means in the form of open bins or containers wherein these items may be conveniently stored within the public areas of the store and at the same time fully displayed for merchandising purposes. Moreover, display bins of the open container type afford easy access to the items so that shoppers may take them for purchase. Display bins such as these are often placed at the end of isles or adjacent check out counters for maximum product visibility.

The present invention relates to a display bin of the above-described type which is easy and inexpensive to manufacture, convenient to ship and/or store in its unassembled form, and easy to assemble. The novel bin disclosed herein is assembled into any desired shape and size from two basic components: (1) one or more flat, molded, plastic, flexible wall sheets and (2) a bottom plate. Generally, each molded wall sheet is shaped in a rectangular form having appropriate length and width dimensions and provided with a plurality of small fastening holes or other suitable fastening means spaced across at least the end edge portions of the sheet. The lower edge portion of the sheet is molded to include a plurality of spaced, vertical ribs.

To assemble the bin, the molded sheet is simply bent about an axis extending widthwise to the sheet to form a three-dimensional body with the opposite end edge portions thereof in an overlapping relation, and the fastening holes of overlapping portions in alignment. Fastening elements are then inserted into several of the aligned fastening holes to fasten the overlapping portions of the sheet together and thereby secure the wall sheet in the three-dimensional form. The exact geometric shape of the wall body may be varied, but in the preferred embodiment, the wall sheet is bent into a cylindrical body.

In accordance with one aspect of the invention, the cylindrical body is arranged so that the molded-in ribs project internally of the body, near the floor, and thus form an annular array of vertical, internal support ribs, The bottom plate rests on and is supported by shoulder portions of these vertical ribs, to form the assembled display bin. To advantage, the bottom plate may be of any appropriate geometric shape, for example, square, oval, circular or triangular, provided adequate rounding of the corners is provided for. The insertion of the shaped bottom plate into the cylindrical body will form the flexible wall sheet of the body into a corresponding cross section.

In one advantageous form of the invention, the lower edge portion of the molded wall sheet is provided with means to support a caster plate below the vertical ribs. The caster plate includes caster rollers so that the assembled display bin may be easily moved about.

In accordance with another feature of the present invention, the vertical ribs may be molded into a multi-step arrangement and the bottom plate may be of appropriately smaller diameter or may be provided with a plurality of notches spaced around the circumference thereof. For example, the vertical ribs may be of a two step configuration. The notches, if used, are of sufficient depth so that the bottom plate may be passed over the upper portions of the vertical ribs, by aligning the plate notches therewith. However, the notches are of insufficient depth to clear the second, raised step or lower portion of the vertical ribs, whereby the bottom plate will be supported by the extending portions of the second rib steps. In the event a shallower depth is desired for the display bin, a notched bottom plate may be oriented such that the notches do not align with the vertical ribs, whereby the plate will be supported by the top portions of the first rib steps. In this manner, the volume of the display bin may be easily varied depending on the amount of merchandise to be stored therein.

To advantage, the wall sheet may also be provided with a plurality of small fastener-receiving openings spaced across the entire width of the sheet. This enables the bottom plate to be raised to an even higher position by inserting support elements through several of the openings, whereby the bottom plate will rest on protruding portions of the support elements.

For display purposes the wall sheet may be molded from a transparent material. Moreover, the wall sheet may be provided with a plurality of large cut portions to further increase product visibility and provide a means for dust to escape from the interior of the bin.

In a useful modification, a pair of display bins may be stacked one above the other, with the upper display bin being of small diameter and spaced above the lower. A bottom plate is provided only in the lower bin. With this arrangement, merchandise packages may be arranged to fill the lower bin and extend up into the bottomless upper bin, with the product exposed and accessible for removal in the space between the bins. As successive articles are removed from the exposed area, they are replenished by gravity feed of new articles from the bottomless upper bin.

To particular advantage, one side edge of the flexible wall sheet is provided with a plurality of integrally molded fastening elements and the other side edge is provided with a plurality of openings for the reception thereof. When assembling the bin, the integral fastening means will be received into the openings of the opposite end of the same sheet (or of similar sheet when several wall sheets are connected edge-to-edge) to secure the wall in the three dimensional body shape. Moreover, the first several vertical ribs adjacent the end edge portions of the flexible wall sheet may be formed to define a nestable cross-section. Upon forming of the wall sheet to make up the display bin, the nestable ribs will be disposed in the overlapping areas of the folded sheets. The projecting ribs of one edge of the sheet will nest within the cavity of the ribs of the overlapping edge. To advantage, the nested ribs will provided added support of the overlapping portion of the assembled display bin.

For a better understanding of the above and other features and advantages of the invention, reference should be made to the following detailed description of preferred embodiments of the invention and to the accompanying drawings.

DETAILED DESCRIPTION OF PREFERRED EMBODIMENTS OF THE INVENTION

Figure 2:
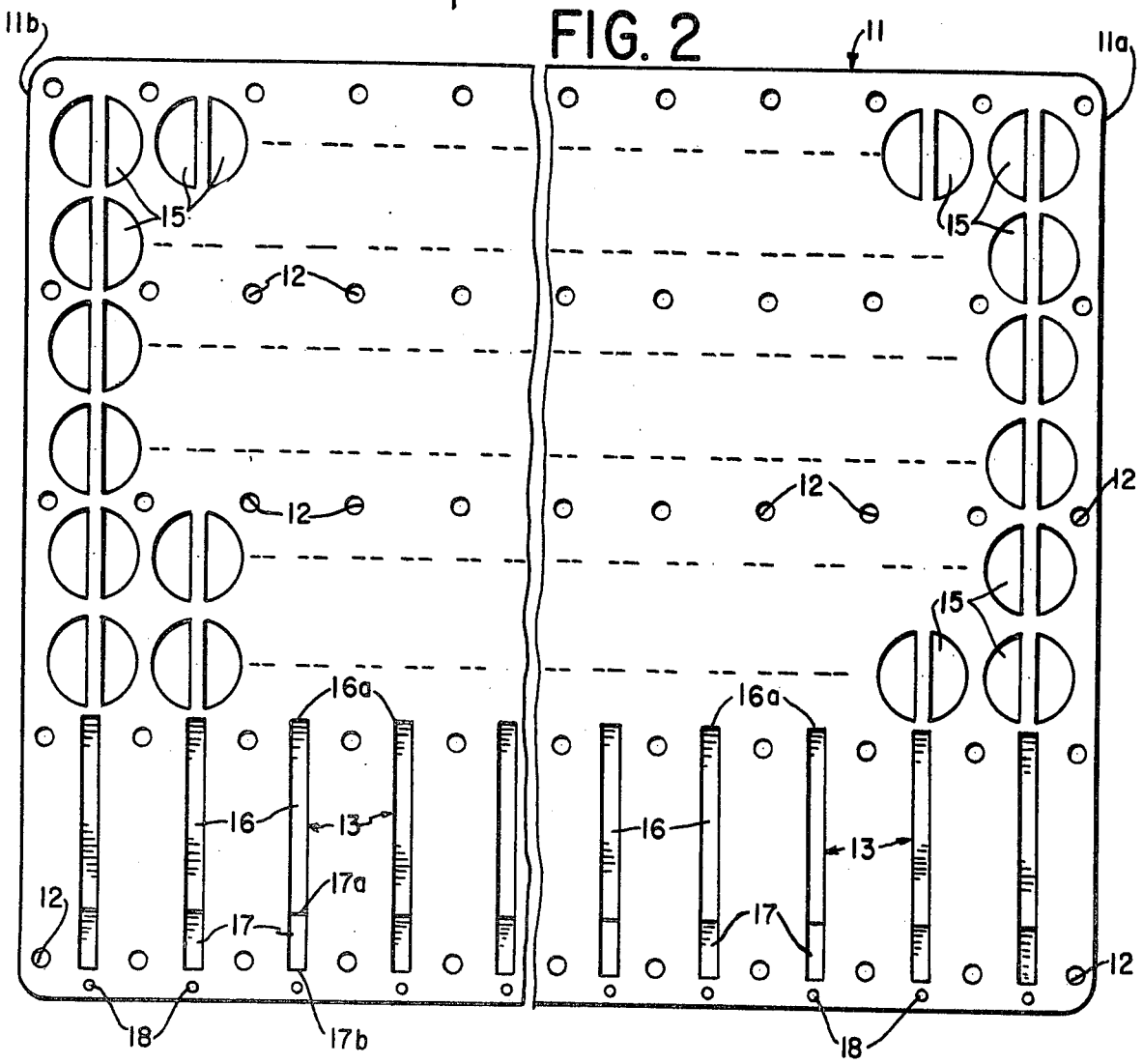
FIG. 2 is a plan view of a molded, flexible wall sheet of the present invention.

Referring now to the drawings and initially to FIG. 2 thereof, the reference numeral 11 designates a flat, flexible wall sheet adapted to form the wall body of the new display bin. Pursuant to an important aspect of the invention, the wall sheet 11 is of molded construction, desirably of a generally rectangular form. Typically, but not by way of limitation, the wall sheet may be formed of a relatively stiff grade of polyvinylchloride and may have a length dimension of approximately 90 cm, a width dimension of approximately 55 cm and a thickness on the order of 1.5 mm. Though not critical to the invention, a sheet 11 of these general dimensions will be particularly suitable for use in retail outlets, as discussed above.

A plurality of small fastener-receiving holes 12 are spaced across the entire surface of the wall sheet 11 in a multiple rectilinear array. In the preferred embodiment of the invention, the holes 12 may have a typical diameter of approximately 6.4 mm.

The wall sheet 11 is also desirably provided with a plurality of large semi-circular openings 15 suitably spaced across the upper portions of the surface of the sheet 11 to provide increased product visibility as well as means for dust to escape from the internal areas of the assembled display bin, as will appear.

In accordance with one aspect of the invention, the lower end edge portion of the wall sheet 11 is molded to include a plurality of vertically extending, parallel, spaced ribs 13. Preferably, each of the ribs 13 is of a multi-step configuration, and in the form illustrated in FIG. 4, comprises a first step 16 and a second step 17. Though not critical to the present invention, typically each rib has a total length of around 25 cm with the first step 16 extending for 20 cm and the second step 17 extending for about 5 cm. In the preferred embodiment, the first rib step 16 projects approximately 4.6 mm from the outer surface of the wall sheet 11 and thereby forms a first shoulder portion **16*a*. The second rib step 17 projects from the outer dimension of the wall sheet 11 approximately 9.2 mm to form a second shoulder portion 17*a***.

Figure 1:
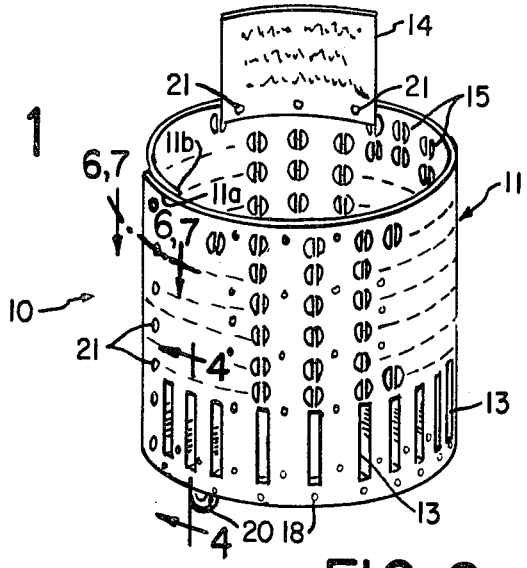
FIG. 1 is a perspective view of an assembled display bin in accordance with the teachings of the present invention.
Figure 6:
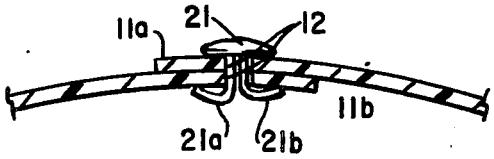
FIGS. 6 and 7 are fragmentary, cross sectional views of one form of the new display bin, taken generally along lines 6—6 and 7—7 respectively of FIG. 1, illustrating typical fastening means for holding the bent wall sheet in a cylindrical form.
Figure 7:
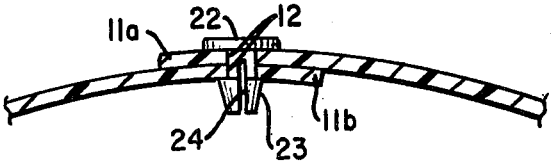
Figure 9:
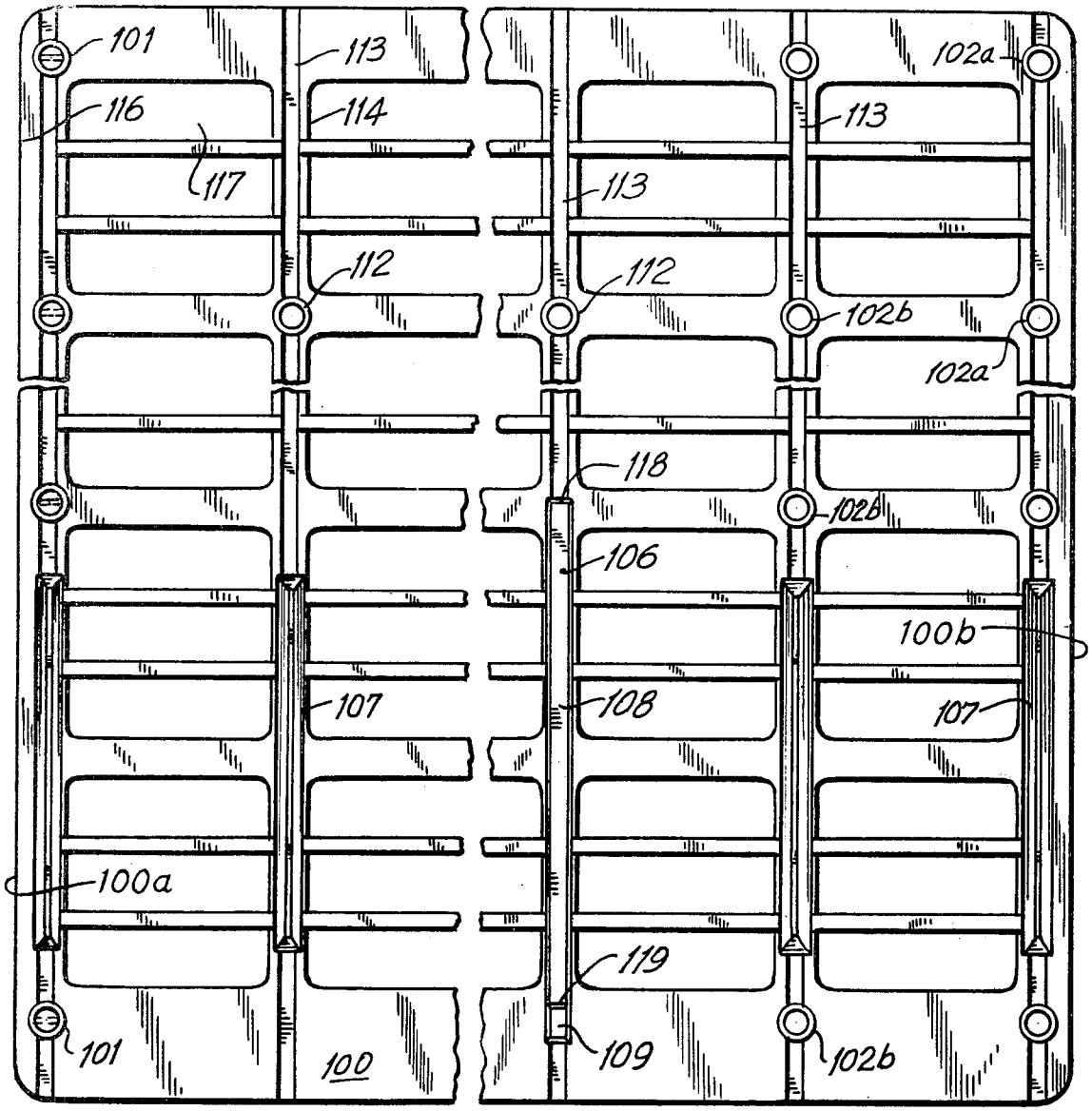
FIG. 9 is a plan view of a modified form of molded, flexible wall sheet of the present invention.

To form the display bin 10 pursuant to the invention, the molded wall sheet 11 is bent into a cylindrical body whereby one side edge portion **11*a* thereof overlaps the other end edge portion 11*b*, as clearly illustrated in FIG. 1, and the ribs 13 extend internally of the body to form an annular array of vertical ribs. Referring to FIGS. 6 and 7, the overlapping end edge portions 11*a*, 11*b* are arranged so that vertically aligned rows of fastener holes 12 spaced along each edge portion are in alignment. A suitable fastener, such as a two-pronged clip 21, may then be inserted through two or more sets of the aligned holes 12 from the outside of the cylindrical body. In the arrangement of FIG. 6, the prongs 21*a*, 21*b* of a conventional metallic clip fastener 21 may be spread apart to securely fasten the wall sheet 11 in the cylindrical form. In the arrangement shown in FIG. 7, a molded plastic snap-in plug fastener 22 may be used in place of the clip 21 to fasten together the overlapping edge portions of the wall sheet 11. The plug fastener 22 is provided with a wedge-shaped front portion 23 and a slit 24 extending lengthwise through and beyond the wedge portion. The plug 22 is simply forced through the aligned sets of holes 12, the wedge portion 23 being compressed until it passes through the holes 12**.

Figure 4:
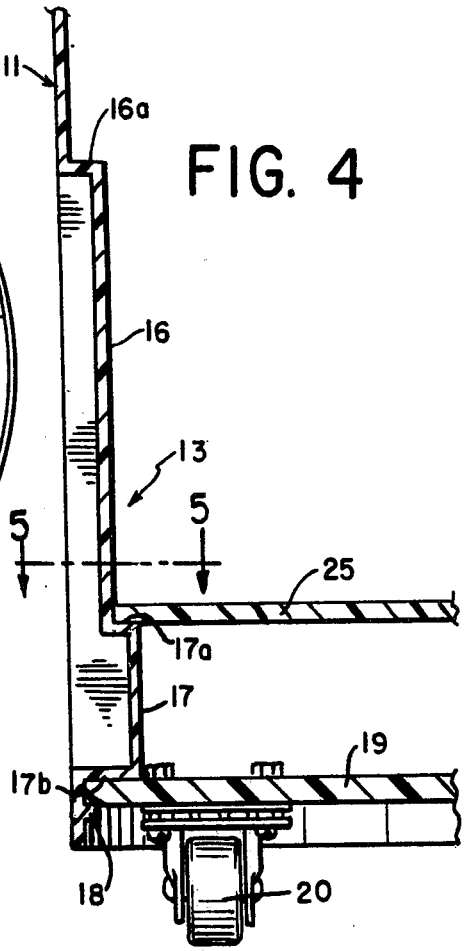
FIG. 4 is a partial detailed cross sectional view of the display bin taken generally along line 4—4 of FIG. 1.
Figure 5:
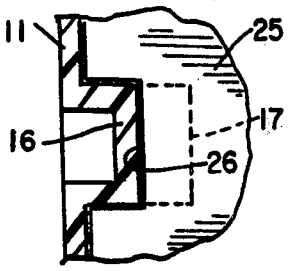
FIG. 5 is a partial cross sectional view of a rib portion of the wall sheet taken generally along line 5—5 of FIG. 4.

To particular advantage, the molded wall sheet 11 may also be provided with a plurality of short, small diameter, button-like projections 18, extending along the lower edge extremity of the sheet, below and spaced a predetermined distance from downwardly facing shoulders **17*b* formed by the lower ends of the rib steps 17. When the sheet 11 is bent into the cylindrical body, as discussed above, a caster plate 19 may be snapped in place and secured between the rib shoulders 17*b* and projections 18, as illustrated in FIG. 4. The caster plate 19 may include swivel casters 20 spaced at predetermined points about the circumference of the plate. This will afford easy maneuverability for the assembled bin 10**.

Figure 3:
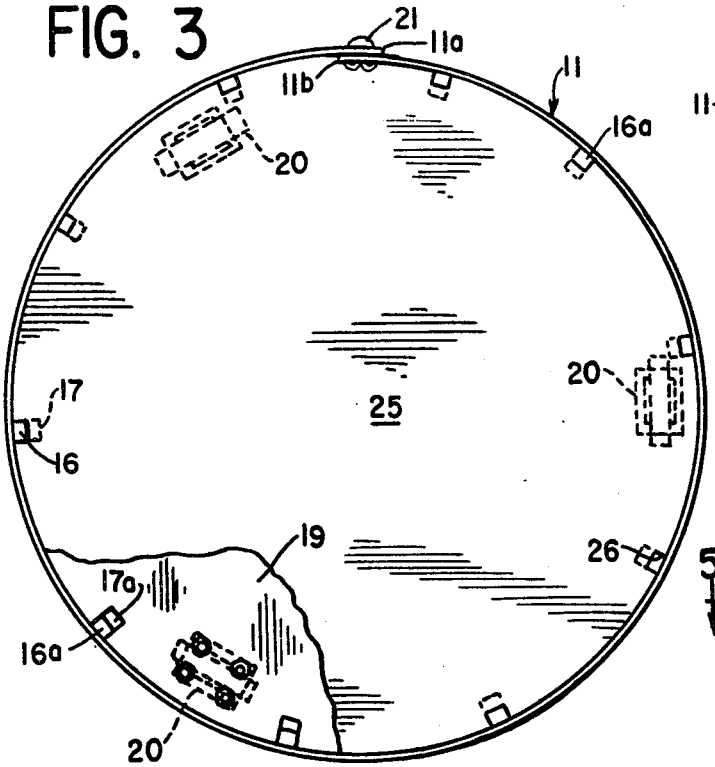
FIG. 3 is a top plan view of a circular molded bottom sheet mounted in the assembled display bin of the invention.

Referring now to FIG. 3, there is illustrated a circular bottom plate 25. The bottom plate 25 may be made from Masonite or a similar material and in one form is shaped to include a plurality of notches 26 spaced around the circumference thereof. The depth of the notches is preferably slighly greater than the inward projection of the upper portions 16 of the ribs 13, (i.e., approximately 4.6 mm). To complete the assembly of the bin 10, after securing together the overlapping side edges of the wall sheet, the bottom plate 25 is inserted into the cylindrical body formed from the wall sheet 11 from the open top thereof. If the plate notches 26 are oriented so that they align with the upper rib portions 16, the bottom plage 25 will pass over the first steps **16*a* of the ribs 13 and rest on the lower shoulders 17*a*. To support the bottom plate 25 at a higher level, however, the plate 25 is inserted into the cylindrical body in such orientation that the notches 26 do not align with the ribs. Consequently, the bottom plate 25 will not be able to pass over the upper rib portions 16 and will therefore be supported by the upper shoulders 16***a*.

It will be understood, of course, that the bottom plate 25 of the display bin need not be circular in form, but can take any of the various forms to which the closed wall sheet may be caused to conform. Thus, triangular, rectangular or similar shapes may be utilized for the bottom plate, provided the corner areas are generously rounded to permit the wall sheet 11 to follow the contours of the bottom plate. Likewise, instead of using a notched-out bottom plate, it is also acceptable to utilize interchangeable, larger and smaller sizes of bottom plates, with the smaller size being received within the confines of the upper rib portions 16 and being seated on the lower rib shoulders 17*a*.

For display purposes, a sign 14 may be mounted on the side wall 11 to supply pertinent product information for shoppers. The sign 14 may be fastened to the side wall 11 by, for example, clips 21 or 22 inserted through the sign 14 and appropriate holes 12 of the wall sheet 11.

Figure 8:
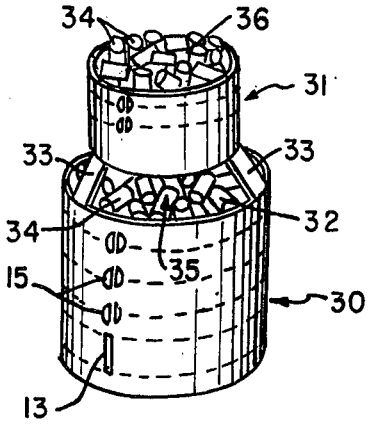
FIG. 8 is a perspective view illustrating another embodiment of the invention.

In the form of the invention shown in FIG. 8, a lower bin 30, which may be generally of the same structure above described, is arranged to support an open bottom bin 31 above and in spaced relation to the open top 32 of the lower bin 30. The upper bin 31 advantageously is of somewhat smaller diameter than the lower bin 30 and is supported from the lower bin by means of a plurality of circumferentially spaced legs 33.

In use, the two-tiered display bin of FIG. 8 may be filled with the product packages 34 to a level well up within the upper bin 31, with the product being manually accessible in the open area 35 provided between the bottom of the upper bin and the top of the lower bin. As product items are removed by customers from the access area 35, new product items will fall by gravity from the upper bin 31 into the access area, providing automatic self-replenishment of the access area. The display bin may be refilled with products from time to time through the open top area 36 of the upper bin.

For particularly eye-catching display arrangements, the multiple tier bin of FIG. 8 may be constructed with three or more vertically spaced units, with the product being arranged to cascade vertically downward to the bottom bin 30.

The upper bin 31, of the assembly of FIG. 8, may be formed of a standard wall sheet 11, of the type shown in FIG. 2. The diameter or cross sectional configuration of the upper bin may be made smaller than that of the lower bin by expedients such as providing additional overlap between the fastened-together confronting edges 11*a*, 11*b*, or a margin may be simply cut off along one edge if desired. Additionally, wall sheets may be made in different sizes, if desired.

Referring now to FIGS. 9–15, there is illustrated another and particularly advantageous embodiment of the display bin of the present invention. A molded, flexible wall sheet 100, generally of the same material, dimensions and construction as the wall sheet 11, is provided with a plurality of integrally molded fastening tabs 101 spaced along one side edge 100*a* of the sheet 100. The other side edge 100*b* is provided with a plurality of holes 102*a,b*. The holes 102*a* are spaced in a vertically aligned linear array closely adjacent the edge 100*b* and the holes 102*b* are spaced in a second linear aray recessed from the edge 100*b*. The integrally molded tabs 101 include an axially extending slit 103, enlarged head portion 104 and a recessed portion 105, whereby the tabs 101 may be snapped into complementary openings 102*a,b*.

In accordance with the invention, the lower end edge portion of the wall sheet 100 is molded to include a plurality of vertically extending, parallel, spaced ribs 106, 107. The ribs 106 may be of a generally rectangular cross sectional configuration and are of a multiple-step configuration. In the preferred form, the ribs 106 comprise a first step 108 and a second step 109. The ribs 106 are functionally the same as the ribs 13 described hereinabove.

In the embodiment of FIGS. 9–15, the first few ribs 107, adjacent the opposite side edge portions 116, 117 of the wall sheet, are molded in a generally triangular cross sectional configuration. This will enable the ribs 107 of one edge to nest in the ribs of an overlapping edge, as will be described below.

Figure 10:
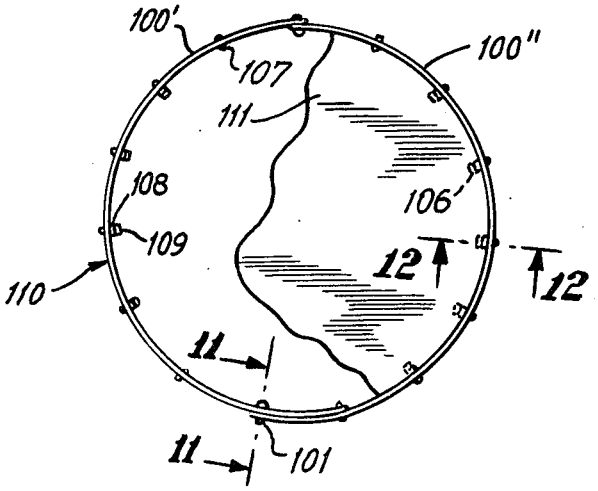
FIG. 10 is a top view of a display bin formed with the wall sheet of FIG. 9.

Referring to FIG. 10, there is illustrated a display bin designated generally by the reference numeral 110. The display bin 110 is formed by the edge-to-edge connection of two wall sheets 110′, 100″. The exact number of wall sheets utilized to form the bin may be varied to obtain a bin of any desired size. The wall sheets 110′, 100″ each comprise a wall sheet 100, as described above. The integrally molded fastening tabs 101 of each sheet 100′, 100″ are received through the openings 102 of the complementary sheet to securely fasten the sheets together. The fastening tabs 101 may be inserted through the first or second vertical row of openings 102*a* or 102*b* depending on how much overlap is desired. The wall sheets 100′, 100″ are arranged such, that the ribs 106, 107 project internally of the bin 110 to form an annular array of vertical ribs.

A bottom plate 111 is then inserted through the open top of the bin 110 and supported by the rib shoulders 118 or 119. As in the prior embodiment, the bottom sheet 111 may be provided with a plurality of notches spaced along the circumference thereof whereby when the notches are aligned with the top step 108 of the ribs 106, the sheet 111 may be lowered to be supported by the lower rib shoulders 119.

Figure 11:
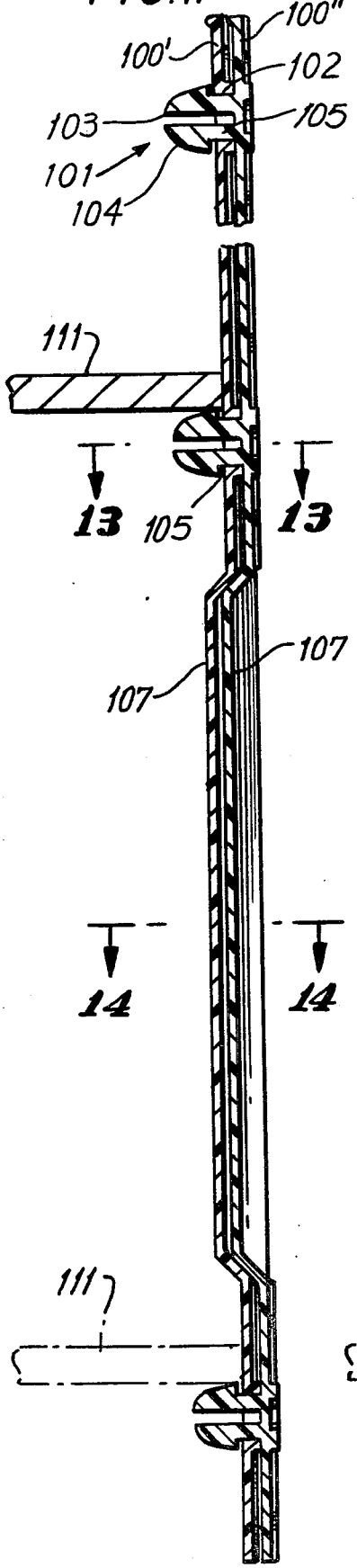
FIG. 11 is a cross sectional view of the display bin taken generally along line 11—11 of FIG. 10.
Figure 12:
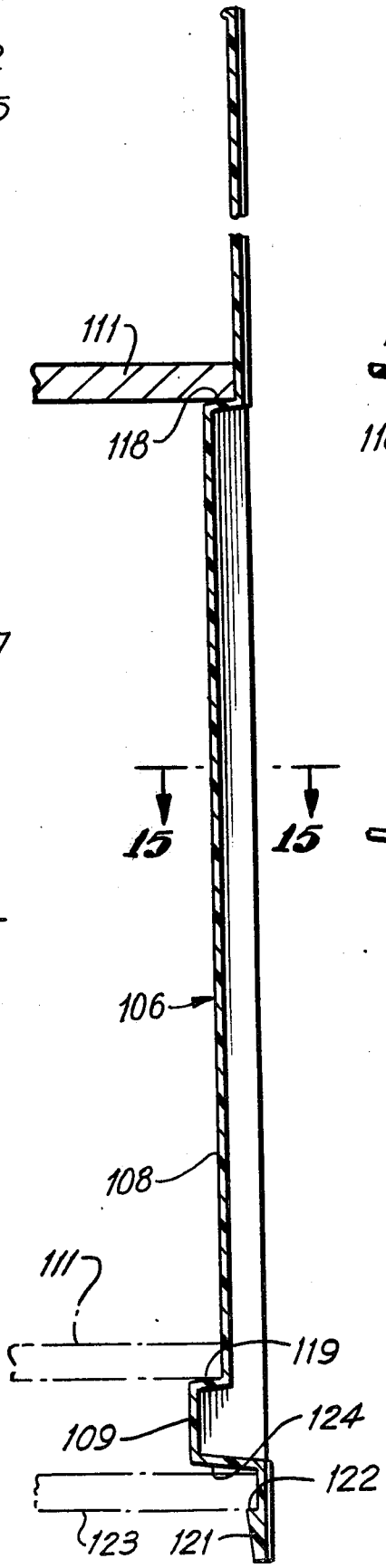
FIG. 12 is a cross section view of the display bin taken generally along line 12—12 of FIG. 10.
Figure 13:
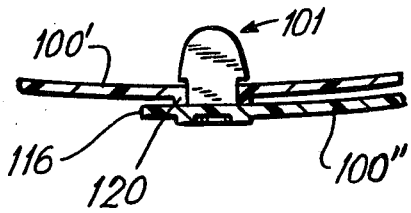
FIG. 13 is a partial cross sectional view of the display bin taken generally along line 13—13 of FIG. 11.
Figure 14:
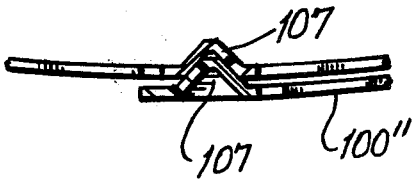
FIG. 14 is a partial cross sectional view of the display bin taken generally along line 14—14 of FIG. 11.
Figure 15:
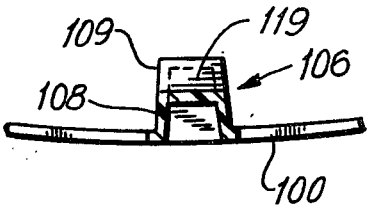
FIG. 15 is a partial cross sectional view of the display bin taken generally along lines 15—15 of FIG. 12.

Referring now to FIGS. 11 and 14, there is illustrated the details of the overlapping portions of the wall sheets 100′, 100″. The triangular shaped ribs 107 of the sheet 100″ will nest within the triangular cavities defined by the ribs 107 of sheet 100′. In the preferred form, the sides, tops and bottoms of the ribs 107 form angles of approximately 45° with respect to the primary plane of the sheet, to facilitate the nesting configuration. The rib 107 will therefore afford easy assembly while providing structural support in the overlapping area of the bin.

As another feature of the present embodiment one or more horizontal rows of openings 112 are provided across the width of the sheet 100 at one or more levels. In the event it is desired to locate the bottom plate 111 at a position above the ribs 106, removable snap-in plug fasteners, similar in construction to the plug fasteners 22 (FIG. 7), may be installed such that the ends thereof project internally of the bin 110. The bottom sheet may then be supported by the fasteners.

As will be understood, when the bottom plate 111 is supported directly by the ribs 106, the weight of the plate and the merchandise is easily supported because of the rigidity imparted to the lower portion of the wall sheet by the ribs 106, 107. When the bottom plate is supported at higher levels, by means of snap-in plug fasteners, the weight of the product must be supported in part by the upper side wall portions of the bin. To this end, reinforcing strips 113 may be molded into the wall sheet, to provide increased strength in the areas of vertical columns 114. In a typical embodiment, in which the thickness of the wall material may be on the order of 70 mils, the ribs 113, integrally molded therewith, may provide an additional thickness of about 55 mils. As reflected in FIG. 9, the fastener-receiving openings, 101, 102, 112, are aligned with the thickened vertical strip areas 113. In addition, each of the openings is formed with a surrounding annular lip 120 of increased thickness to impart greater strength in the regions of such openings.

The wall sheets 100 are also provided with a plurality of openings 117 spaced across the surface thereof for product visability, ventilation and weight reduction.

A plurality of wedge-shaped ribs 121 are spaced along the bottom edge of the sheet 100 and are provided with upwardly facing shoulders 122. A caster plate 123 may be supported between the shoulders 122 and the lower surfaces 124 of the ribs 106.

One of the significant advantages of the present invention, resides in the fact that the component parts thereof are substantially flat and thus may be shipped and stored with a maximum of convenience. At the same time, an extraordinary degree of versatility is provided in the style and form of the assembled display bin. Thus, the flat, molded wall sheet is assembled to form a cylinder or other closed configuration. By varying the geometric shape of the bottom plate, a wide variety of shapes and styles of bins may be achieved.

Another significant feature is the utilization of vertical ribs to support the bottom plate. This arrangement provides a solid construction for the display bin without the need for secondary support features such as internal partition walls. Moreover, the precise design of the present invention permits the entire wall sheet bin to be manufactured in a single molding operation. All of the support and connector means can be made integral with the flexible wall sheets. There is no need for any secondary operations to complete the manufacture of the wall sheets.

In addition, by the use of notched-out bottom plates and/or plates of different size, the product support level of the bin may be provided close to the bottom or well up along the side wall of the bin, as may be appropriate to the circumstances. The molded-in support ribs, for the bottom plate, also serve in a dual capacity of providing support for a caster plate, where it is desired to provide for mobility in the display bin.

With a single, standard-size molded wall sheet, it is possible to form bin configurations of various sizes. Thus, while the standard-size bin may be constructed by overlapping the first rows of fastener openings, along the opposite side edges of the wall plate, smaller bin configurations may be achieved by arranging for greater overlap of the edges. Where extra large bin configurations are desired, a plurality of the wall plates may be secured together edge to edge.

Exemplary of the versatility and utility of the new bin construction is the modification of FIG. 8, in which the two bins are arranged one above the other in a pyramid configuration, to provide a self-replenishing display arrangement, with the product being available for removal at a convenient height.

With the display bin of the invention, the weight load of the bottom plate is transferred directly to the side wall of the ribbed wall sheet. Secondary supporting structure, which is characteristic of known display assemblies of a similar general type, is neither necessary nor desireable. Because of the unique design of the wall sheet, the sheet may be injection molded and is in finished, ready-to-use form when stripped from the molding machine.

Although edge fasteners most advantageously are molded in along one edge of the wall sheet, separate fasteners may be used where desired. Moreover, independent fasteners or similar projecting elements, such as the molded fasteners 22, can be used to advantage to provide support levels for the bottom plate above the tops of the molded in ribs. The independent fasteners are also useful for mounting display signs or the like.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A display bin for displaying and storing articles which comprises (a) a molded, initially flat, flexible, generally rectangular wall sheet of plastic material, having side edge portions and end edge portions, (b) said flexible wall sheet being deformable into a three-dimensional wall body whereby the opposite side edge portions of the wall sheet are in a contacting relation, (c) fastening means operable to secure said side edge portions together thereby maintaining said wall sheet in the three-dimensional wall body form, (d) a plurality of spaced, integrally molded, axially elongated ribs projecting from the surface of said wall sheet internally to the volume defined by said three-dimensional wall body and extending vertically and generally parallel to the side edge portions of the wall sheet and generally perpendicular to the end edge portions of the wall sheet to from an annular array of vertical ribs within the confines of said three-dimensional wall body, (e) at least two of said ribs including at least a portion thereof extending substantially parallel to the end edge portions of the wall sheet, (f) a bottom plate received in said three-dimensional wall body and supported by said substantially parallel portions of said at least two ribs, whereby the weight of said bottom plate and said display articles is distributed into said wall body through said vertical ribs when the display articles are supported by the bottom plate, and (g) said bottom plate serving to form and retain the cross-sectional configuration of the three-dimensional wall body.

2. The display bin of claim 1, further characterized by (a) said at least two ribs each including a plurality of means forming a supporting surface substantially parallel to the end edge portions of the wall sheet, (b) said surface-forming means being spaced along the axial length of each of said at least two ribs, and (c) said bottom plate being supported by selected ones of said supporting surface-forming means.

3. The display bin of claim 1, further characterized by (a) said flexible wall sheet being deformed into a generally cylindrical body, and (b) said molded bottom sheet being of a generally circular form.

4. The display bin of claim 3, further characterized by
(a) said flexible wall sheet including downwardly facing support means formed by said ribs and positioned adjacent the lower edge portion of said wall body, and
(b) a caster plate received within said wall body and engaged by said support means when said wall sheet is deformed into said cylindrical body.

5. The display bin of claim 1, further characterized by
(a) said flexible wall sheet including a plurality of enlarged openings spaced across the surface of said wall sheet for increased visual access.

6. The display bin of claim 1, further characterized by
(a) a plurality of openings being formed in a vertical, spaced array at each of the side edge portions of the wall sheet, and
(b) said wall sheet being deformed into said three-dimensional body whereby the side edge portions overlap and the openings of the overlapping side edge portions are in alignment,
(c) said fastening means comprising a plurality of elements each being received in an aligned pair of said openings.

7. In combination with the bin of claim 1,
(a) a second, open bottom bin supported above and in spaced relation to the first bin and being generally concentric therewith,
(b) the space between said bins providing visual and manual access to products held in said bins.

8. The display bin of claim 1, further characterized by
(a) said fastening means comprising projecting elements integrally molded on said wall sheet along one edge thereof and insertable in openings along the opposite side edge of the same or another wall sheet.

9. The display bin of claim 1, further characterized by
(a) said wall sheet being arranged for each of its side edges to be in overlapping relation with an edge of the same or another sheet,
(b) said projecting ribs including ribs of nestable cross-sectional configuration along the side edges of the wall sheet.

10. The display bin of claim 1, further characterized by
(a) said wall sheet having one or more horizontal rows of openings above said ribs,
(b) projecting elements receivable in said openings in at least non-overlapped areas of said wall sheet,
(c) said bottom plate being supportable by said projecting elements.

11. A display bin assembly which comprises
(a) a molded, initially flat, flexible generally rectangular wall sheet of plastic material having side edge portions and end edge portions,
(b) said wall sheet including fastening means associated with the side edge portions thereof,
(c) said flexible wall sheets being deformed into a three-dimensional wall body whereby the opposite side edge portions thereof are in a contacting relation,
(d) said three-dimensional body including a principal axis extending between the end edge portions thereof,
(e) said fastening means being operative to secure sald wall sheet in said three-dimensional form,
(f) a plurality of spaced, projecting ribs formed integrally with said wall sheet and extending vertically upward from adjacent the bottom end edge portion of the wall sheet,
(g) said projecting ribs comprising a first portion projecting from said wall sheet a first predetermined distance and a second portion projecting from said wall sheet a second predetermined distance, greater than said first predetermined distance,
(h) a bottom plate received in said three-dimensional body and supportable by at least certain of said projecting ribs,
(i) said bottom plate including a plurality of notched portions spaced around the outer perimeter thereof,
(j) said notch portions having a depth at least slightly greater than the first predetermined distance and less than the second predetermined distance,
(k) whereby said bottom plate may be received in said three-dimensional wall body with said notch portions in alignment with said first portions of the projecting ribs thereby passing over said first portions and being supported by the second portions of the projecting ribs.

12. The display bin of claim 11, further characterized by
(a) said bottom sheet being received in said wall body whereby said notched portions are misaligned with said first rib portions, thereby being supported by said first rib portions.

* * * * *